US011717720B2

(12) United States Patent
Foust

(10) Patent No.: US 11,717,720 B2
(45) Date of Patent: Aug. 8, 2023

(54) ABDOMINAL EXERCISE ASSEMBLY

(71) Applicant: Adam Foust, McDonough, GA (US)

(72) Inventor: Adam Foust, McDonough, GA (US)

( * ) Notice: Subject to any disclaimer, the term of this patent is extended or adjusted under 35 U.S.C. 154(b) by 0 days.

(21) Appl. No.: 17/374,615

(22) Filed: Jul. 13, 2021

(65) Prior Publication Data

US 2023/0020746 A1 Jan. 19, 2023

(51) Int. Cl.
*A63B 23/02* (2006.01)
*A63B 21/16* (2006.01)
*A63B 21/00* (2006.01)

(52) U.S. Cl.
CPC ..... *A63B 23/0211* (2013.01); *A63B 21/1627* (2013.01); *A63B 21/4034* (2015.10)

(58) Field of Classification Search
CPC ..... A63B 23/0211; A63B 21/1627; A63B 21/4034; A63B 1/00; A63B 21/1636; A63B 23/1218; A63B 2225/09; A63B 23/1227; A63B 21/0442; A63B 21/0552; A63B 23/1236
See application file for complete search history.

(56) References Cited

U.S. PATENT DOCUMENTS 2,050,652 A * 8/1936 Amos ..... A63B 23/0211 482/140
4,116,434 A * 9/1978 Bernstein ..... A63B 21/1645 D21/687
4,182,510 A 1/1980 Lundell
4,185,816 A * 1/1980 Bernstein ..... A63B 23/0211 482/140
4,212,458 A * 7/1980 Bizilia ..... A63B 21/1654 482/140
4,757,990 A * 7/1988 Dosch ..... A63B 69/004 482/40
5,290,215 A * 3/1994 Lin ..... A63B 21/1654 482/145
5,342,274 A * 8/1994 Hunker ..... A63B 23/0211 482/904
9,630,054 B1 4/2017 Russo
10,589,149 B2 * 3/2020 Tellam ..... A63B 69/0062
2006/0128541 A1 * 6/2006 Boyle ..... A63B 21/4037 482/148
2012/0115693 A1 * 5/2012 Franques Garcia ..... A63B 23/0211 482/140
2013/0217544 A1 * 8/2013 Anaya ..... A63B 23/1218 482/40
2016/0256723 A1 * 9/2016 Intlekofer ..... A63B 21/1627
2021/0339075 A1 * 11/2021 Listro ..... A63B 1/00

* cited by examiner

*Primary Examiner* — Andrew S Lo
*Assistant Examiner* — Andrew M Kobylarz

(57) ABSTRACT

An abdominal exercise assembly includes a bracket that is longitudinally elongated to extend substantially across a door frame. The bracket has a pair of foot recesses each integrated into the bracket to have a respective one of a user's feet positioned in the foot recesses. A plurality of foot pads is each positioned on the bracket and each of the foot pads extends along a respective one of the foot recesses to cushion a respective one of the user's feet when the user's feet are extended into the foot recesses. A pair of clamps is each movably integrated into the bracket. Each of the clamps is movable toward or away from the bracket to engage opposite sides of the door frame for retaining the bracket in the door frame.

8 Claims, 5 Drawing Sheets

ABDOMINAL EXERCISE ASSEMBLY

(b) CROSS-REFERENCE TO RELATED APPLICATIONS

Not Applicable

(c) STATEMENT REGARDING FEDERALLY SPONSORED RESEARCH OR DEVELOPMENT

Not Applicable

(d) THE NAMES OF THE PARTIES TO A JOINT RESEARCH AGREEMENT

Not Applicable

(e) INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

(f) STATEMENT REGARDING PRIOR DISCLOSURES BY THE INVENTOR OR JOINT INVENTOR

Not Applicable

(g) BACKGROUND OF THE INVENTION

(1) Field of the Invention

The disclosure relates to exercise devices and more particularly pertains to a new exercise device for holding a user's feet for performing abdominal exercises. The device includes a bracket that has foot recesses and a pair of clamps movably integrated into the bracket. The bracket is positionable in a door frame having each of the clamps engaging opposite sides of the door frame. In this way the user's feet and can be positioned in the foot recesses to assist the user with performing abdominal exercises.

(2) Description of Related Art Including Information Disclosed Under 37 CFR 1.97 and 1.98

The prior art relates to exercise devices including a bracket that is attachable to a mount and a bar integrated into the bracket beneath which a user's feet can be positioned for performing sit up exercises. The prior art discloses a variety of devices that includes a bracket that engages a bottom edge of a door and which has sleeves integrated into the bracket for receiving a user's feet for performing sit up exercises.

(h) BRIEF SUMMARY OF THE INVENTION

An embodiment of the disclosure meets the needs presented above by generally comprising a bracket that is longitudinally elongated to extend substantially across a door frame. The bracket has a pair of foot recesses each integrated into the bracket to have a respective one of a user's feet positioned in the foot recesses. A plurality of foot pads is each positioned on the bracket and each of the foot pads extends along a respective one of the foot recesses to cushion a respective one of the user's feet when the user's feet are extended into the foot recesses. A pair of clamps is each movably integrated into the bracket. Each of the clamps is movable toward or away from the bracket to engage opposite sides of the door frame for retaining the bracket in the door frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

(i) BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

(j) DETAILED DESCRIPTION OF THE INVENTION

Figure 1:
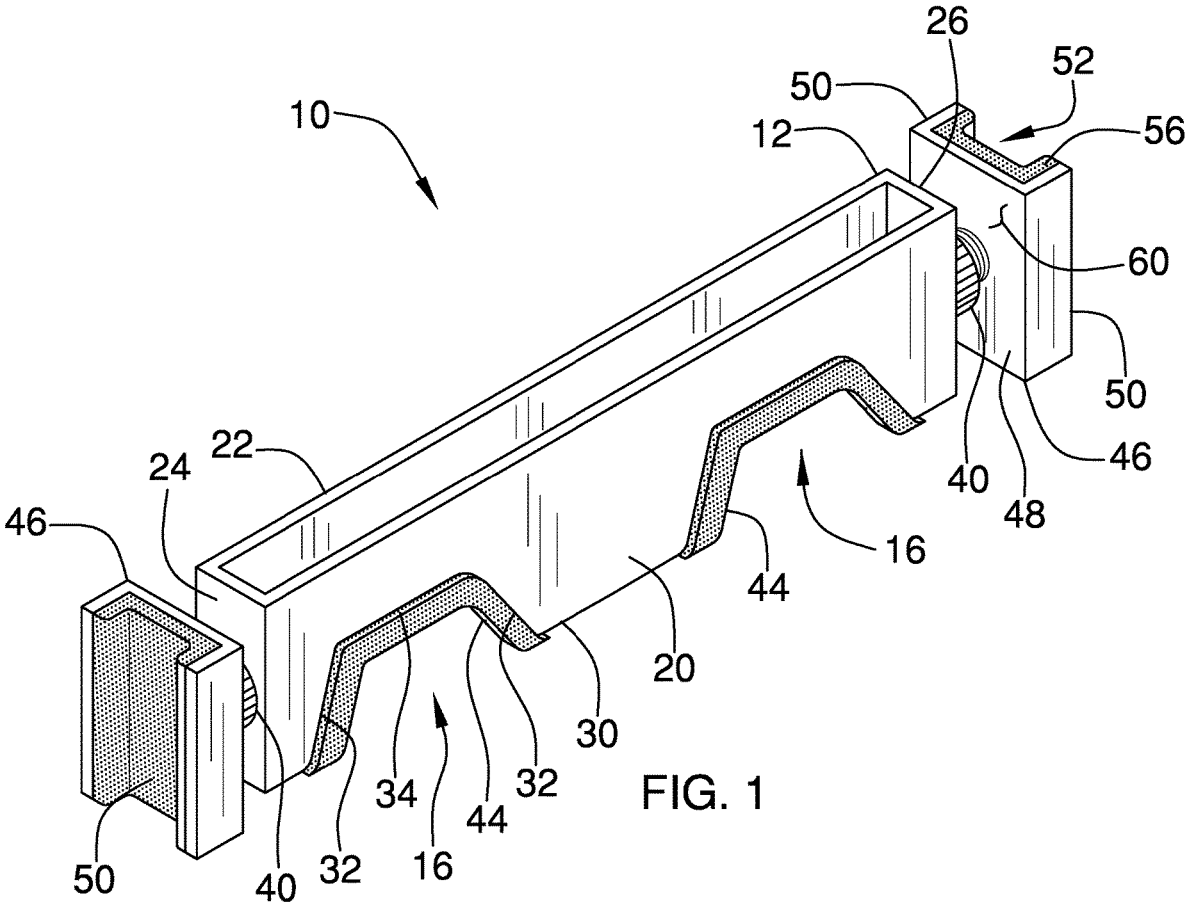
FIG. 1 is a top perspective view of an abdominal exercise assembly according to an embodiment of the disclosure.
Figure 2:
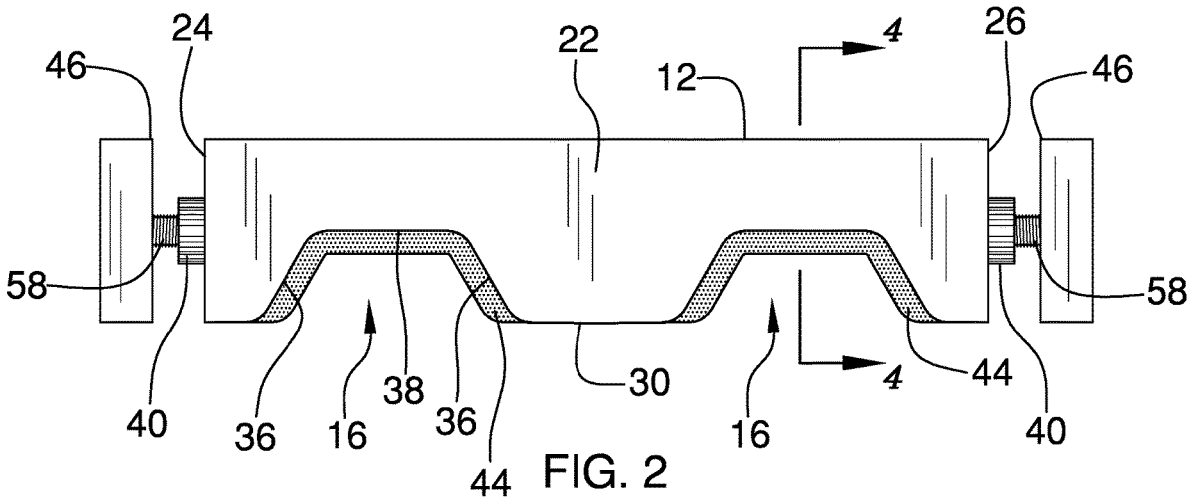
FIG. 2 is a back view of an embodiment of the disclosure.
Figure 3:
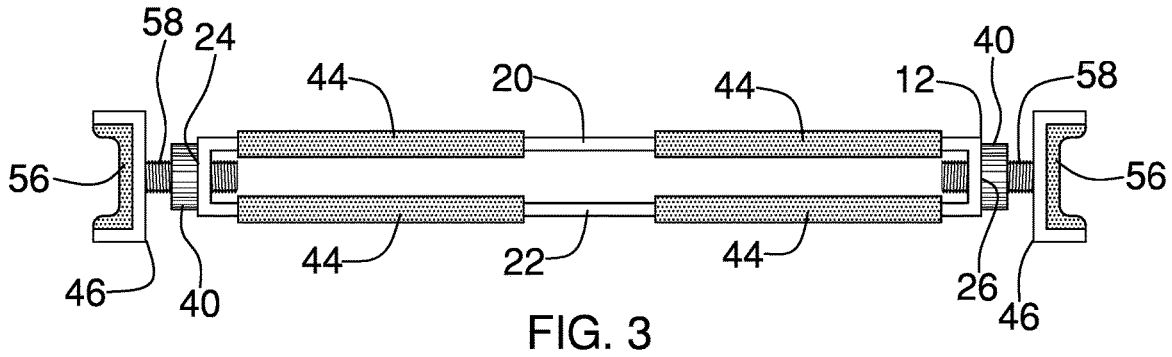
FIG. 3 is a bottom view of an embodiment of the disclosure.
Figure 4:
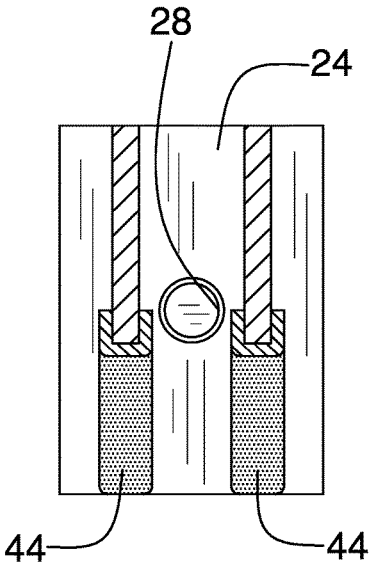
FIG. 4 is a cross sectional view taken along line 4-4 of FIG. 2 of an embodiment of the disclosure.
Figure 5:
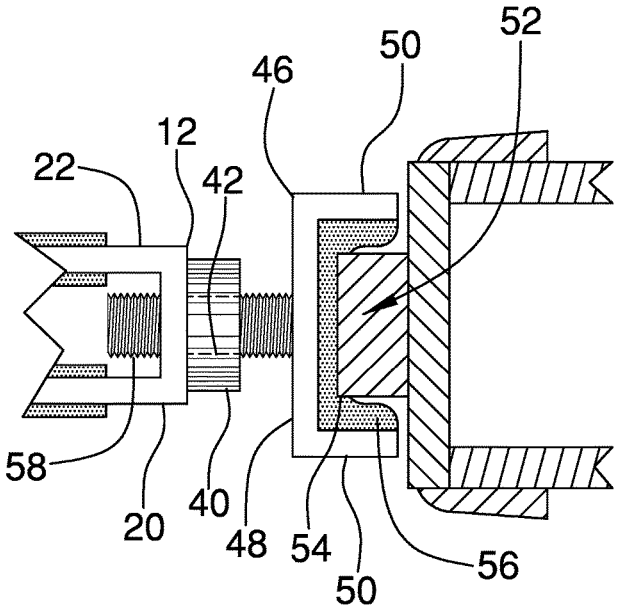
FIG. 5 is a cross sectional view taken along line 5-5 of FIG. 6 of an embodiment of the disclosure.
Figure 6:
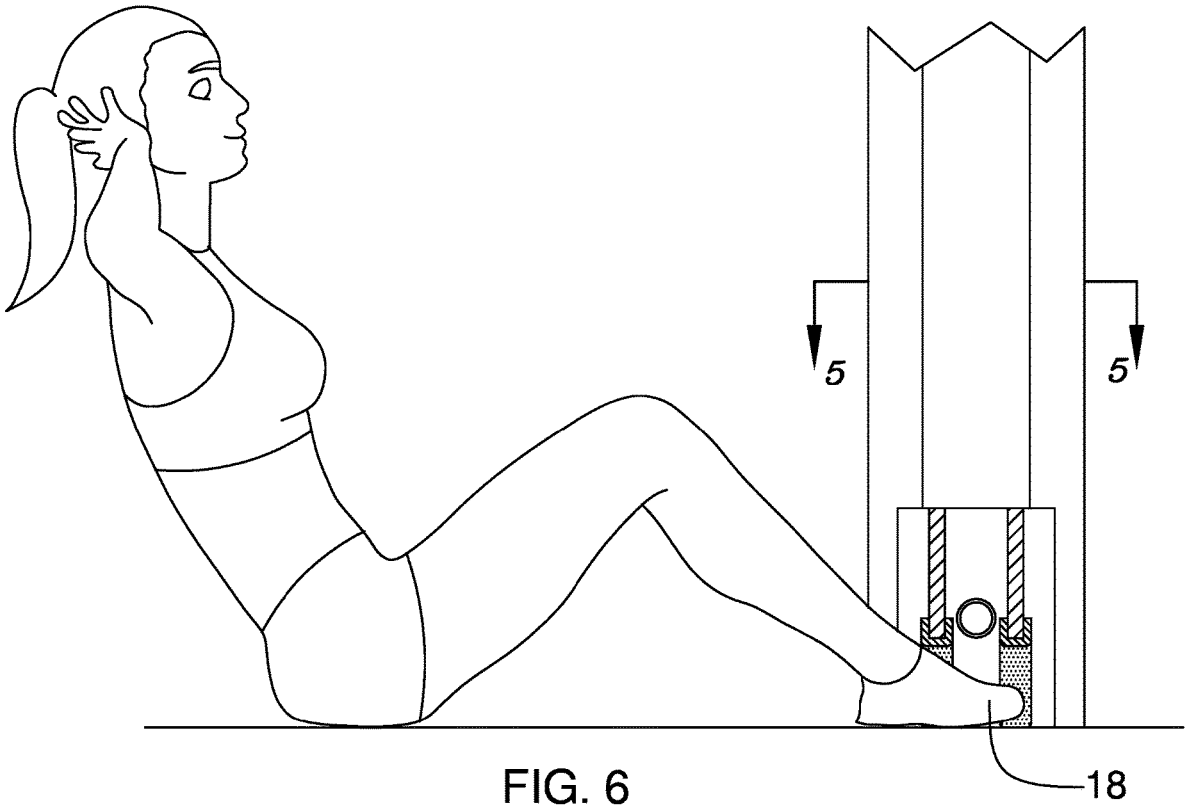
FIG. 6 is a perspective in-use view of an embodiment of the disclosure.
Figure 7:
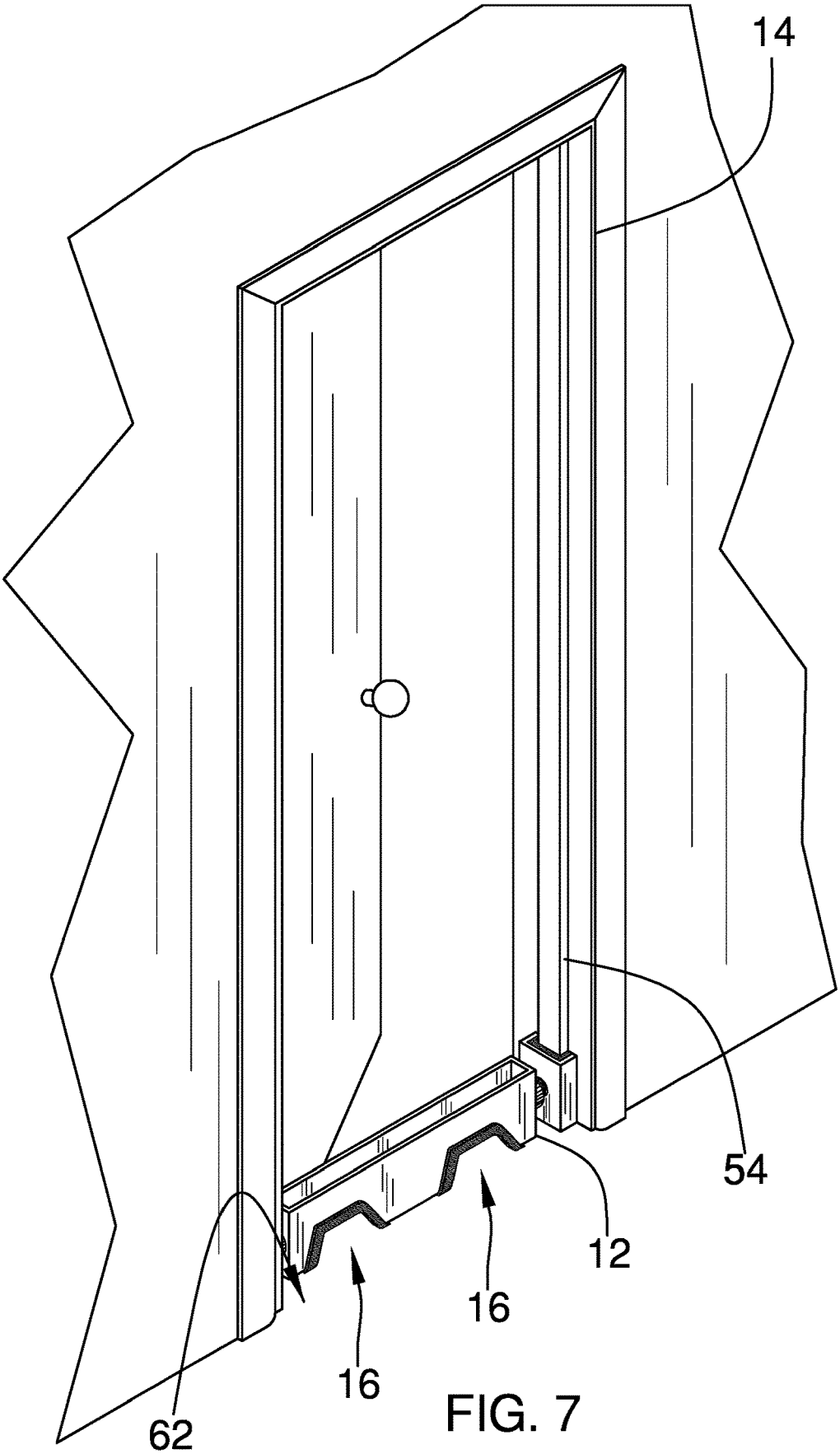
FIG. 7 is a perspective view of an embodiment of the disclosure showing a bracket installed in a door frame.

With reference now to the drawings, and in particular to FIGS. 1 through 7 thereof, a new exercise device embodying the principles and concepts of an embodiment of the disclosure and generally designated by the reference numeral 10 will be described.

As best illustrated in FIGS. 1 through 7, the abdominal exercise assembly 10 generally comprises a bracket 12 that is longitudinally elongated such that the bracket 12 can be extended substantially across a door frame 14. The door frame 14 may be a door frame for an interior door in a home, for example, or other similar type of door frame. The bracket 12 has a pair of foot recesses 16 each integrated into the bracket 12 for having a respective one of a user's feet 18 positioned in the foot recesses 16. The bracket 12 has a front wall 20 and a back wall 22, and the bracket 12 has a first lateral wall 24 and a second lateral wall 26 each extending between the front wall 20 and the back wall 22. The bracket 12 is elongated between the first lateral wall 24 and the second lateral wall 26, and each of the first lateral wall 24 and the second lateral wall 26 has a screw hole 28 extending therethrough.

Each of the front wall 20 and the back wall 22 has a bottom edge 30, and the bottom edge 30 of the front wall 20 has a respective pair of the foot recesses 16 integrated into the bottom edge 30 of the front wall 20. Each of the foot recesses 16 in the front wall 20 has a pair of angled surfaces 32 extending between a horizontal surface 34. The horizontal surface 34 extends along a line that is oriented parallel to the bottom edge 30 of the front wall 20. Each of the angled surfaces 32 angles between the bottom edge 30 and the horizontal surface 34 such that each of the pair of foot recesses 16 in the front wall 20 has a trapezoidal shape. Each of the foot recesses 16 in the front wall 20 is positioned adjacent to a respective one of the first lateral wall 24 and the second lateral wall 26 of the bracket 12.

The bottom edge 30 of the back wall 22 has a respective pair of the foot recesses 16 integrated into the bottom edge 30 of the back wall 22. Each of the foot recesses 16 in the back wall 22 has a pair of angled surfaces 36 extending between a horizontal surface 38. The horizontal surface 38 corresponding to the foot recesses 16 in the back wall 22 extends along a line is oriented parallel to the bottom edge 30 of the back wall 22. Additionally, each of the angled surfaces 36 corresponding to the foot recesses 16 in the back wall 22 angles between the bottom edge 30 of the back wall 22 and the horizontal surface 34 corresponding to a respective foot recess in the back wall 22 such that each of the pair of foot recesses 16 in the back wall 22 has a trapezoidal shape. Furthermore, each of the foot recesses 16 in the back wall 22 is aligned with a respective one of the foot recesses 16 in the front wall 20.

A pair of collars 40 is each rotatably integrated into a respective one of the first lateral wall 24 and the second lateral wall 26 of the bracket 12. Each of the collars 40 is aligned with the screw hole 28 in the respective first lateral wall 24 and the second lateral wall 26. Each of the collars 40 has an interior surface 42 and the interior surface 42 of each of the collars 40 is threaded. A plurality of foot pads 44 is provided and each of the foot pads 44 is positioned on the bracket 12. Each of the foot pads 44 extends along a respective one of the foot recesses 16 to cushion a respective one of the user's feet 18 when the user's feet 18 are extended into the foot recesses 16. Furthermore, each of the foot pads 44 extends along the angled surfaces 32 and the horizontal surface 34 of the respective foot recess. Each of the foot pads 44 is comprised of a resiliently compressible material, such as rubber for example, to cushion the user's feet 18.

A pair of clamps 46 is each movably integrated into the bracket 12 and each of the clamps 46 is movable toward or away from the bracket 12. In this way each of the clamps 46 can engage opposite sides of the door frame 14 for retaining the bracket 12 in the door frame 14. Each of the clamps 46 has a central panel 48 extending between a pair of outward panels 50. The outward panels 50 are spaced apart from each other and are oriented perpendicular to the central panel 48 such that each of the clamps 46 has a U-shape. Furthermore, a jamb space 52 is defined between the outward panels 50 to receive a respective door jamb 54 on the door frame 14 for restraining the bracket 12 in the door frame 14. A pair of clamp pads 56 is provided and each of the clamp pads 56 is coupled to an interior surface 42 of the central panel 48 and each of the outward panels 50 of a respective one of the clamps 46. In this way each of the clamp pads 56 can frictionally engage the respective door jamb 54.

A pair of screws 58 provided and each of the screws 58 is coupled to and extends away from an outside surface 60 of the central panel 48 of a respective one of the clamps 46. Each of the screws 58 extends through a respective one of the collars 40 and each of the screws 58 threadably engages the interior surface 42 of the respective collar 40. Furthermore, each of the screws 58 extends through the screw hole 28 in a respective one of the first lateral wall 24 and the second lateral wall 26 of the bracket 12. Each of the screws 58 is extended outwardly from the respective collar 40 when the respective collar 40 is rotated in a first direction thereby moving the respective clamp 46 away from the bracket 12. Conversely, each of the screws 58 is retracted into the respective collar 40 when the respective collar 40 is rotated in a second direction thereby moving the respective clamp 46 toward the bracket 12.

In use, the bracket 12 is positioned to extend along a bottom threshold 62 of the door jamb 54 and each of the collars 40 is rotated in the first direction such that the clamps 46 engage the sides of the door jamb 54. In this way the bracket 12 is retained in the door frame 14. The user's feet 18 are inserted into the respective foot recesses 16. In this way the user's feet 18 are restrained thereby facilitating the user to perform sit-up exercises and other abdominal exercises.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An abdominal exercise assembly for restraining a user's feet while performing sit up exercises, said assembly comprising:

a bracket being longitudinally elongated wherein said bracket is configured to be extended substantially across a door frame, said bracket having a pair of foot recesses each being integrated into said bracket wherein each of said foot recesses is configured to have a respective one of a user's feet being positioned in said foot recesses;

a plurality of foot pads, each of said foot pads being positioned on said bracket, each of said foot pads extending along a respective one of said foot recesses wherein each of said foot pads is configured to cushion a respective one of the user's feet when the user's feet are extended into said foot recesses; and a pair of clamps, each of said clamps being movably integrated into said bracket, each of said clamps being movable toward or away from said bracket wherein each of said clamps is configured to engage opposite sides of the door frame for retaining said bracket in the door frame; and wherein said bracket has a front wall and a back wall, said bracket having a first lateral wall and a second lateral wall each extending between said front wall and said back wall, said bracket being elongated between said first lateral wall and said second lateral wall, each of said first lateral wall and said second lateral wall having a screw hole extending therethrough, each of said front wall and said back wall having a bottom edge, said bottom edge of said front wall having a respective pair of said foot recesses being integrated into said bottom edge of said front wall, said bottom edge of said back wall having a respective pair of said foot recesses being integrated into said bottom edge of said back wall.

2. The assembly according to claim 1, wherein:

each of said foot recesses in said front wall has a pair of angled surfaces extending between a horizontal surface, said horizontal surface extending along a line being oriented parallel to said bottom edge of said front wall, each of said angled surfaces angling between said bottom edge and said horizontal surface such that each of said pair of foot recesses in said front wall has a trapezoidal shape, each of said foot recesses in said front wall being positioned adjacent to a respective one of said first lateral wall and said second lateral wall of said bracket; and each of said foot recesses in said back wall has a pair of angled surfaces extending between a horizontal surface, said horizontal surface corresponding to said foot recesses in said back wall extending along a line being oriented parallel to said bottom edge of said back wall, each of said angled surfaces corresponding to said foot recesses in said back wall angling between said bottom edge of said back wall and said horizontal surface corresponding to a respective foot recess in said back wall such that each of said pair of foot recesses in said back wall has a trapezoidal shape, each of said foot recesses in said back wall being aligned with a respective one of said foot recesses in said front wall.

3. The assembly according to claim 1, further comprising a pair of collars, each of said collars being rotatably integrated into a respective one of said first lateral wall and said second lateral wall of said bracket, each of said collars being aligned with said screw hole in said respective first lateral wall and said second lateral wall, each of said collars having an interior surface, said interior surface of each of said collars being threaded.

4. The assembly according to claim 1, wherein each of said clamps has a central panel extending between a pair of outward panels, said outward panels being spaced apart from each other and being oriented perpendicular to said central panel such that each of said clamps has a U-shape having a jamb space defined between said outward panels wherein said jamb space is configured to receive a respective door jamb on the door frame for restraining said bracket in the door frame.

5. The assembly according to claim 4, further comprising a pair of clamp pads, each of said clamp pads being coupled to an interior surface of said central panel and each of said outward panels of a respective one of said clamps wherein each of said clamp pads is configured to frictionally engage the respective door jamb.

6. An abdominal exercise assembly for restraining a user's feet while performing sit up exercises, said assembly comprising:

a bracket being longitudinally elongated wherein said bracket is configured to be extended substantially across a door frame, said bracket having a pair of foot recesses each being integrated into said bracket wherein each of said foot recesses is configured to have a respective one of a user's feet being positioned in said foot recesses;

a plurality of foot pads, each of said foot pads being positioned on said bracket, each of said foot pads extending along a respective one of said foot recesses wherein each of said foot pads is configured to cushion a respective one of the user's feet when the user's feet are extended into said foot recesses;

a pair of clamps, each of said clamps being movably integrated into said bracket, each of said clamps being movable toward or away from said bracket wherein each of said clamps is configured to engage opposite sides of the door frame for retaining said bracket in the door frame, wherein each of said clamps has a central panel extending between a pair of outward panels, said outward panels being spaced apart from each other and being oriented perpendicular to said central panel such that each of said clamps has a U-shape having a jamb space defined between said outward panels wherein said jamb space is configured to receive a respective door jamb on the door frame for restraining said bracket in the door frame;

a pair of collars, each of said collars being rotatably integrated into a respective one of a first lateral wall and a second lateral wall of said bracket, each of said collars being aligned with a screw hole in said respective first lateral wall and said second lateral wall, each of said collars having an interior surface, said interior surface of each of said collars being threaded; and a pair of screws, each of said screws being coupled to and extending away from an outside surface of said central panel of a respective one of said clamps, each of said screws extending through a respective one of said collars, each of said screws threadably engaging said interior surface of said respective collar having each of said screws extending through said screw hole in a respective one of said first lateral wall and said second lateral wall of said bracket.

7. The assembly according to claim 6, wherein each of said screws is extended outwardly from said respective collar when said respective collar is rotated in a first direction thereby moving said respective clamp away from said bracket, each of said screws being retracted into said respective collar when said respective collar is rotated in a second direction thereby moving said respective clamp toward said bracket.

8. An abdominal exercise assembly for restraining a user's feet while performing sit up exercises, said assembly comprising:

a bracket being longitudinally elongated wherein said bracket is configured to be extended substantially across a door frame, said bracket having a pair of foot recesses each being integrated into said bracket wherein each of said foot recesses is configured to have a respective one of a user's feet being positioned in said foot recesses, said bracket having a front wall and a back wall, said bracket having a first lateral wall and a second lateral wall each extending between said front wall and said back wall, said bracket being elongated between said first lateral wall and said second lateral wall, each of said first lateral wall and said second lateral wall having a screw hole extending therethrough, each of said front wall and said back wall having a bottom edge, said bottom edge of said front wall having a respective pair of said foot recesses being integrated into said bottom edge of said front wall, each of said foot recesses in said front wall having a pair of angled surfaces extending between a horizontal surface, said horizontal surface extending along a line being oriented parallel to said bottom edge of said front wall, each of said angled surfaces angling between said bottom edge and said horizontal surface such that each of said pair of foot recesses in said front wall has a trapezoidal shape, each of said foot recesses in said front wall being positioned adjacent to a respective one of said first lateral wall and said second lateral wall of said bracket, said bottom edge of said back wall having a respective pair of said foot recesses being integrated into said bottom edge of said back wall, each of said foot recesses in said back wall having a pair of angled surfaces extending between a horizontal surface, said horizontal surface corresponding to said foot recesses in said back wall extending along a line being oriented parallel to said bottom edge of said back wall, each of said angled surfaces corresponding to said foot recesses in said back wall angling between said bottom edge of said back wall and said horizontal surface corresponding to a respective foot recess in said back wall such that each of said pair of foot recesses in said back wall has a trapezoidal shape, each of said foot recesses in said back wall being aligned with a respective one of said foot recesses in said front wall;

a pair of collars, each of said collars being rotatably integrated into a respective one of said first lateral wall and said second lateral wall of said bracket, each of said collars being aligned with said screw hole in said respective first lateral wall and said second lateral wall, each of said collars having an interior surface, said interior surface of each of said collars being threaded;

a plurality of foot pads, each of said foot pads being positioned on said bracket, each of said foot pads extending along a respective one of said foot recesses wherein each of said foot pads is configured to cushion a respective one of the user's feet when the user's feet are extended into said foot recesses, each of said foot pads extending along said angled surfaces and said horizontal surface of said respective foot recess;

a pair of clamps, each of said clamps being movably integrated into said bracket, each of said clamps being movable toward or away from said bracket wherein each of said clamps is configured to engage opposite sides of the door frame for retaining said bracket in the door frame, each of said clamps having a central panel extending between a pair of outward panels, said outward panels being spaced apart from each other and being oriented perpendicular to said central panel such that each of said clamps has a U-shape having a jamb space defined between said outward panels wherein said jamb space is configured to receive a respective door jamb on the door frame for restraining said bracket in the door frame;

a pair of screws, each of said screws being coupled to and extending away from an outside surface of said central panel of a respective one of said clamps, each of said screws extending through a respective one of said collars, each of said screws threadably engaging said interior surface of said respective collar having each of said screws extending through said screw hole in a respective one of said first lateral wall and said second lateral wall of said bracket, each of said screws being extended outwardly from said respective collar when said respective collar is rotated in a first direction thereby moving said respective clamp away from said bracket, each of said screws being retracted into said respective collar when said respective collar is rotated in a second direction thereby moving said respective clamp toward said bracket; and a pair of clamp pads, each of said clamp pads being coupled to an interior surface of said central panel and each of said outward panels of a respective one of said clamps wherein each of said clamp pads is configured to frictionally engage the respective door jamb.

* * * * *